US007185968B2

(12) United States Patent
Kim et al.

(10) Patent No.: US 7,185,968 B2
(45) Date of Patent: Mar. 6, 2007

(54) INK-JET PRINTHEAD PACKAGE

(75) Inventors: Sang-chae Kim, Suwon-si (KR); Jae-woo Chung, Suwon-si (KR); Seung-mo Lim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 258 days.

(21) Appl. No.: 10/833,039

(22) Filed: Apr. 28, 2004

(65) Prior Publication Data

US 2005/0012775 A1 Jan. 20, 2005

(30) Foreign Application Priority Data

May 1, 2003 (KR) ..... 10-2003-0028002

(51) Int. Cl.
*B41J 2/015* (2006.01)

(52) U.S. Cl. ..... 347/20

(58) Field of Classification Search ..... 347/20, 347/40, 47, 54, 68, 87
See application file for complete search history.

(56) References Cited

U.S. PATENT DOCUMENTS

| | | | | |
|---|---|---|---|---|
| 4,680,859 A | | 7/1987 | Johnson | |
| 5,475,279 A | * | 12/1995 | Takeuchi et al. | 310/331 |
| 5,559,542 A | * | 9/1996 | Tsukuda | 347/58 |
| 5,606,352 A | | 2/1997 | Yamakawa et al. | |
| 6,206,499 B1 | | 3/2001 | Iijima et al. | 347/33 |
| 6,244,696 B1 | * | 6/2001 | Tran et al. | 347/87 |
| 6,257,703 B1 | * | 7/2001 | Hirosawa et al. | 347/50 |
| 6,322,200 B1 | | 11/2001 | Feinn et al. | |
| 6,679,595 B2 | * | 1/2004 | Yamada et al. | 347/87 |

FOREIGN PATENT DOCUMENTS

| | | | |
|---|---|---|---|
| EP | 0 666 174 A2 | | 8/1995 |
| EP | 0 666 174 A3 | | 8/1995 |
| EP | 1 034 931 A1 | | 9/2000 |
| JP | 08276586 | * | 10/1996 |
| JP | 9-174833 | | 7/1997 |

* cited by examiner

*Primary Examiner*—Anh T. N. Vo
(74) *Attorney, Agent, or Firm*—Lee & Morse, P.C.

(57) ABSTRACT

An ink-jet printhead package includes a frame having a first surface and a second surface with a hollow and an ink supply hole, the hollow and the ink supply hole extending through the frame, the ink supply hole providing flow communication between the first surface and the second surface, a groove formed on the second surface of the frame, the groove surrounding the hollow and the ink supply hole, an adhesive coating an interior of the groove, and a printhead chip having a first surface and a second surface, the first surface of the printhead chip having a plurality of nozzles formed thereon and the second surface of the printhead chip being adhered to the frame by the adhesive, the printhead chip being operable to eject ink supplied through the ink supply hole through the plurality of nozzles.

13 Claims, 8 Drawing Sheets

INK-JET PRINTHEAD PACKAGE

BACKGROUND OF THE INVENTION

1. Field of the Invention

The present invention relates to an ink-jet printhead package. More particularly, the present invention relates to an ink-jet printhead package having a simplified structure that facilitates cleaning of a printhead, e.g., by wiping with a blade.

2. Description of the Related Art

Typically, ink-jet printheads are devices for printing a predetermined color image by ejecting a small volume droplet of printing ink at a desired position on a recording sheet, textile, or the like. Ink-jet printheads are largely categorized into two types depending on which mechanism is used to eject an ink droplet. A first type of ink-jet printhead is a thermally driven ink-jet printhead, in which a heat source is employed to form and expand bubbles in ink causing ink droplets to be ejected. A second type of ink-jet printhead is a piezoelectrically driven ink-jet printhead, in which a piezolectric crystal bends to exert pressure on ink causing ink droplets to be ejected.

Ink-jet printheads are typically manufactured in a chip shape using various methods, including a semiconductor manufacturing process. In addition, a packaging is required to mount the manufactured printhead chip in a printer.

FIG. 1 illustrates a conventional ink-jet printhead package. Referring to FIG. 1, the conventional ink-jet printhead package includes a passage unit 16 including a nozzle plate 13, on which a plurality of nozzles 11 is arranged in rows; a passage formation plate 14, on which a plurality of pressure chambers corresponding to each of the plurality of nozzles 11 is formed; and an elastic plate 15, which transfers vibration of a piezoelectric actuator 12, which is fixed in a casing 17, to change the volumes of the pressure chambers. The passage unit 16 is fixed in the casing 17 by a head cover 19 having a window for exposing the nozzles 11.

In the conventional ink-jet printhead package, when a portion of the ink droplets ejected from the nozzles 11 remains on a surface of the nozzle plate 13, the ink droplets remaining on the surface of the nozzle plate 13 mix with ink of other colors, or change an ejection direction of the ink droplets, thereby resulting in a lower printing quality. Thus, a wiping blade is typically used to remove the ink remaining on the surface of the nozzle plate 13. When the printhead package moves in a reciprocating motion, the wiping blade contacts the surface of the nozzle plate 13 and wipes the ink remaining on the surface.

However, in this conventional ink-jet printhead package, an entire periphery of the surface of the nozzle plate 13 is covered with the head cover 19. Thus, a wiping blade, which can be somewhat elastically-transformed, is not able to closely contact a region of the nozzle plate 13 near the head cover 19. Accordingly, the ink remaining on the nozzle plate 13 cannot be sufficiently removed.

As such, ink-jet printhead packages that attempt to prevent the above problems have been developed. An example of another conventional ink-jet printhead package is shown in FIGS. 2 through 4. FIG. 2 illustrates a perspective view of a conventional ink-jet printhead package. FIG. 3 illustrates a cross-sectional view, taken in a direction A, of a wiping blade and a head cover shown in FIG. 2. FIG. 4 illustrates a cross-sectional view, taken in a direction B, of the wiping blade and the head cover shown in FIG. 2;

The conventional ink-jet printhead package shown in FIGS. 2 through 4 includes a casing 32, a passage unit 34 having a nozzle plate 41, on which a plurality of nozzles 43 is formed, and a head cover 35 that secures the passage unit 34 in the casing 32.

The head cover 35 has four sidewalls 50. Each of the four sidewalls 50 contact a corresponding side of the casing 32. An overlap portion 51 of the head cover 35 covers a portion of the surface of the nozzle plate 41. The overlap portion 51 is provided only on the sidewalls 50 of the head cover 35 that are perpendicular to a wiping direction (direction of arrow B). No overlap portion is provided on the sidewalls 50 of the head cover 35 that are parallel to the wiping direction (direction of arrow A), thereby forming a wiping space 52.

Referring now to FIGS. 3 and 4, in the conventional ink-jet printhead package having the above structure, when a surface of the nozzle plate 41 is wiped with a wiping blade 56, the wiping blade 56 contacts the entire width of the surface of the nozzle plate 41, so that any ink K remaining on the surface of the nozzle plate 41 can be easily removed.

However, in the aforementioned ink-jet printhead package, as shown in FIG. 4, the overlap portion 51 of the head cover 35 is on a portion of the nozzle plate 41 to secure the passage unit 34, and the nozzle plate 41, in the casing 32. Due to this contact, ink can spread between the nozzle plate 41 and the overlap portion 51 and may be subsequently scattered on an object to be printed during a printing operation, resulting in a lower printing quality. In addition, a step, i.e., a difference in height, is formed between the surface of the nozzle plate 41 and the overlap portion 51. As a result, an unstable motion of the wiping blade 56 occurs. In addition, ink that is not removed by the wiping blade 56 is stacked in a corner portion of the surface of the nozzle plate 41 adjacent to the step formed by the overlap portion 51 of the head cover 35.

SUMMARY OF THE INVENTION

The present invention provides an ink-jet printhead package having a simplified structure in which, due to an absence of a head cover, a printhead may be easily wiped.

According to a feature of an embodiment of the present invention, there is provided an ink-jet printhead package including a frame having a first surface and a second surface with a hollow and an ink supply hole, the hollow and the ink supply hole extending through the frame, the ink supply hole providing flow communication between the first surface and the second surface, a groove formed on the second surface of the frame, the groove surrounding the hollow and the ink supply hole, an adhesive coating an interior of the groove, and a printhead chip having a first surface and a second surface, the first surface of the printhead chip having a plurality of nozzles formed thereon and the second surface of the printhead chip being adhered to the frame by the adhesive, the printhead chip being operable to eject ink supplied through the ink supply hole through the plurality of nozzles. In the package, the frame may be formed of plastic.

Preferably, the adhesive is a room temperature vulcanizing (RTV) silicon resin. Alternatively, the adhesive may include a room temperature vulcanizing (RTV) silicon resin coating an interior of a first portion of the groove, the first portion of the groove surrounding the ink supply hole and an epoxy resin coating an interior of a second portion of the groove, the second portion of the groove substantially surrounding the hollow.

The package may further include a support surface formed by an inner edge of the groove that is adjacent to the hollow and the ink supply hole, the support surface contacting and supporting the printhead chip, wherein the support surface is recessed a predetermined depth from the second surface of the frame. Preferably, the predetermined depth is greater than or equal to a thickness of the printhead chip. Also preferably, the predetermined depth is substantially equal to the thickness of the printhead chip so that the first surface of the printhead chip and the second surface of the frame are coplanar.

In the package, the printhead chip may include a plurality of ink chambers to be filled by ink supplied through the ink supply hole, a plurality of nozzles formed at positions corresponding to the plurality of ink chambers, and an actuator for providing a driving force to eject ink inside the ink chambers through the plurality of nozzles.

Preferably, the actuator is a piezoelectric actuator, and the piezoelectric actuator includes a vibration plate located on the plurality of ink chambers and a piezoelectric body located on the vibration plate, the piezoelectric body being operable to vibrate the vibration plate. The piezoelectric actuator may further include a lower electrode located under the piezoelectric body, the lower electrode serving as a common electrode and an upper electrode located on the piezoelectric body, the upper electrode serving as a driving electrode for applying a voltage to the piezoelectric body.

Further, the printhead chip may include an upper substrate having the plurality of ink chambers and an ink induction hole aligned with the ink supply hole formed therein, a middle substrate having a reservoir and a plurality of restrictors providing flow communication between the ink induction hole and the plurality of ink chambers, and a plurality of dampers providing flow communication between the plurality of ink chambers and the plurality of nozzles formed therein, and a lower substrate having the plurality of nozzles formed therein, the piezoelectric actuator being formed on the upper substrate.

The package may further include a bracket, in which a printed circuit board is installed, combined with an upper portion of the frame, wherein the printed circuit board and the printhead chip are electrically connected by a flexible printed circuit and an ink supply hose providing flow communication to the ink supply hole.

The package may further include a nipple, in which the ink supply hose is inserted, installed in the ink supply hole. The nipple may be formed of stainless steel.

The above-described ink-jet printhead package according to an embodiment of the present invention does not include a head cover, thereby facilitating a wiping of the printhead chip and simplifying a structure of the ink-jet printhead package.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1:
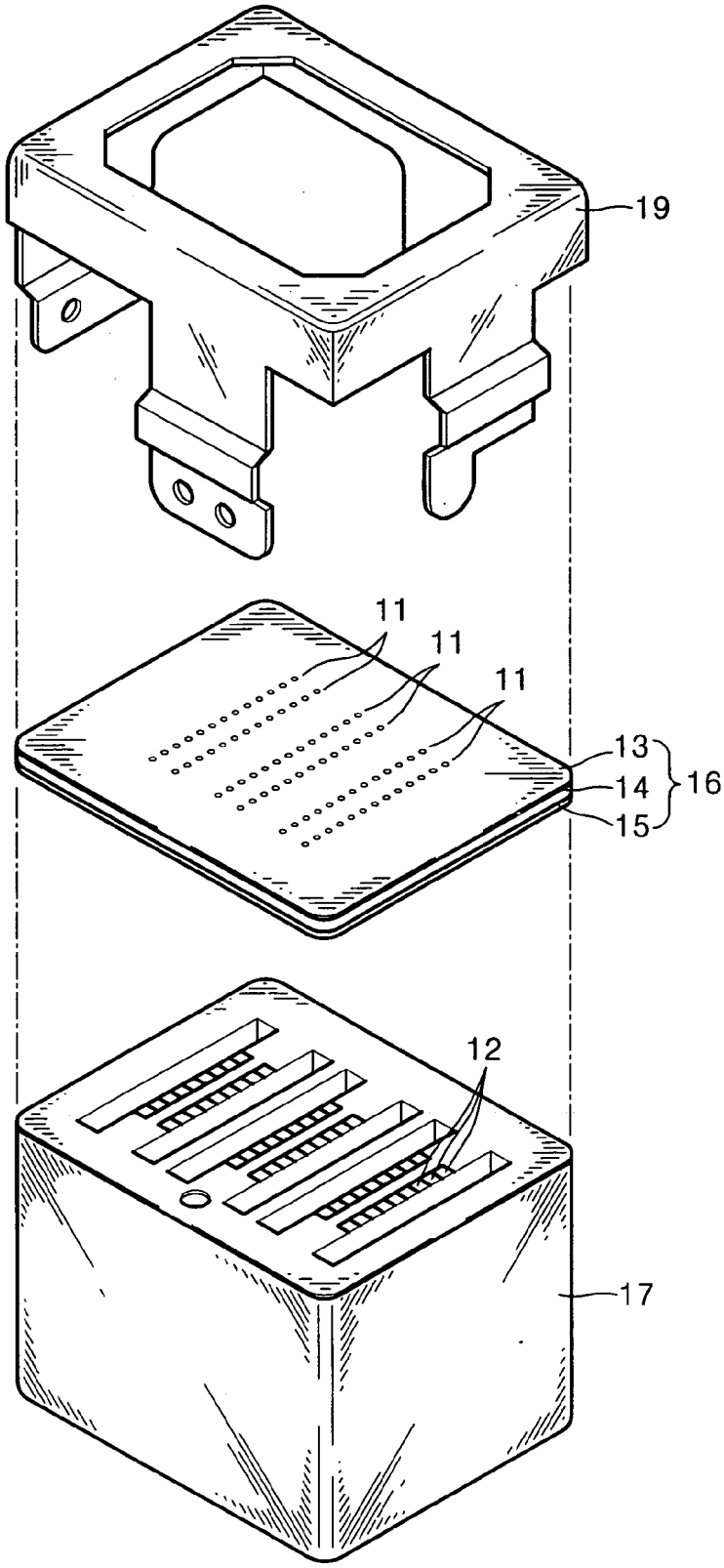
FIG. 1 (PRIOR ART)
FIG. 1 illustrates an exploded perspective view of a conventional ink-jet printhead package.
Figure 2:
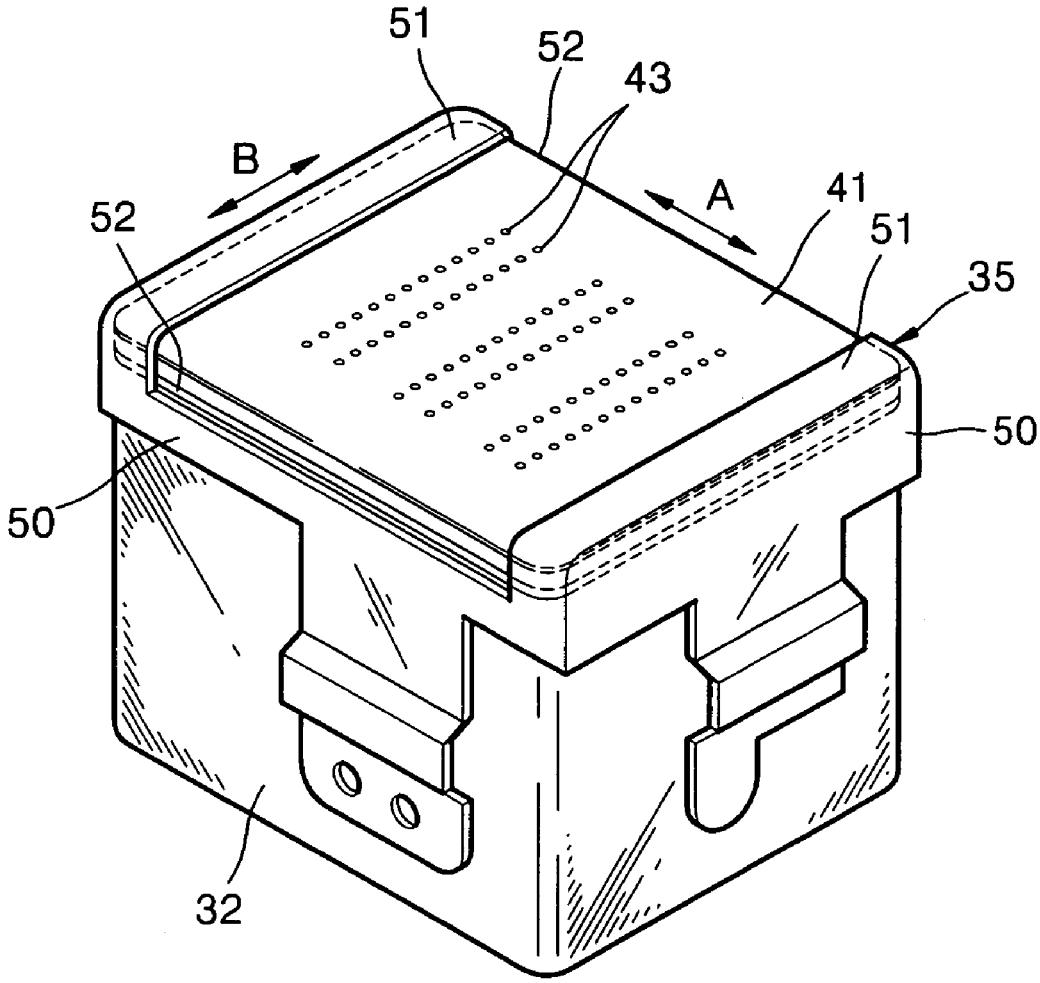
FIG. 2 (PRIOR ART)
FIG. 2 illustrates a perspective view of a conventional ink-jet printhead package.
Figure 3:
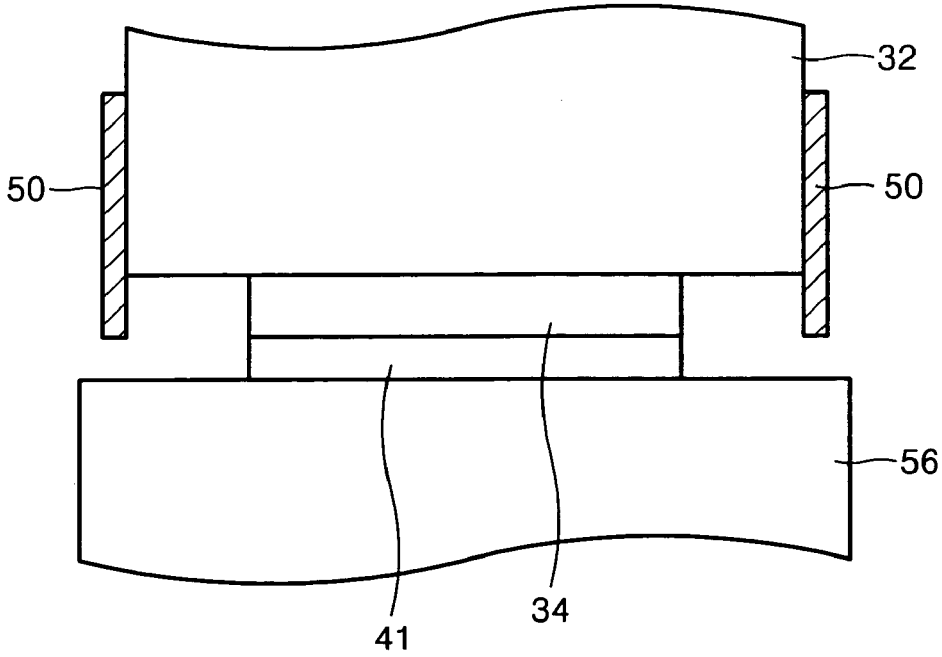
FIG. 3 (PRIOR ART)
FIG. 3 illustrates a cross-sectional view, taken in a direction A, of a wiping blade and a head cover shown in FIG. 2.
Figure 4:
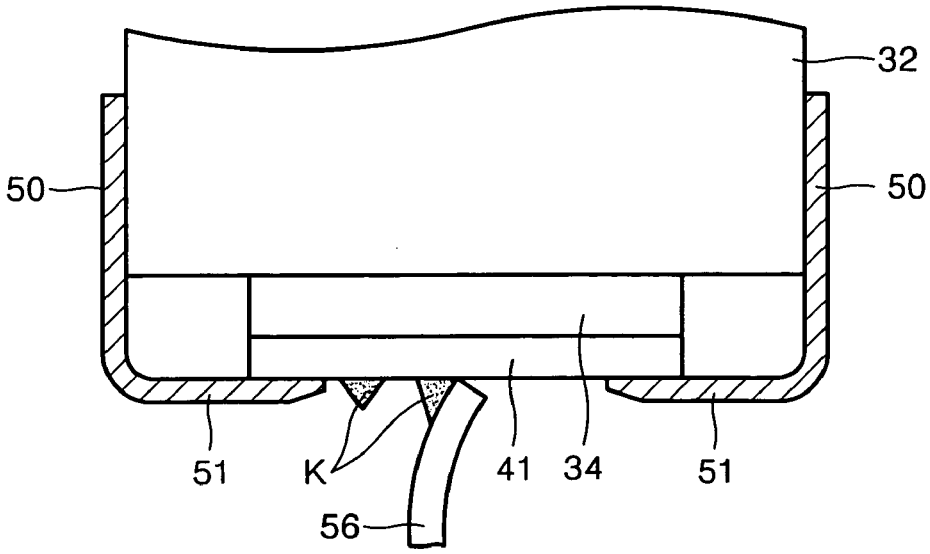
FIG. 4 (PRIOR ART)
FIG. 4 illustrates a cross-sectional view, taken in a direction B, of the wiping blade and the head cover shown in FIG. 2.

Korean Patent Application No. 2003-28002, filed on May 1, 2003, and entitled: "Ink-Jet Printhead Package," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of elements and regions may be exaggerated for clarity of illustration. Like reference numerals refer to like elements throughout.

Figure 5:
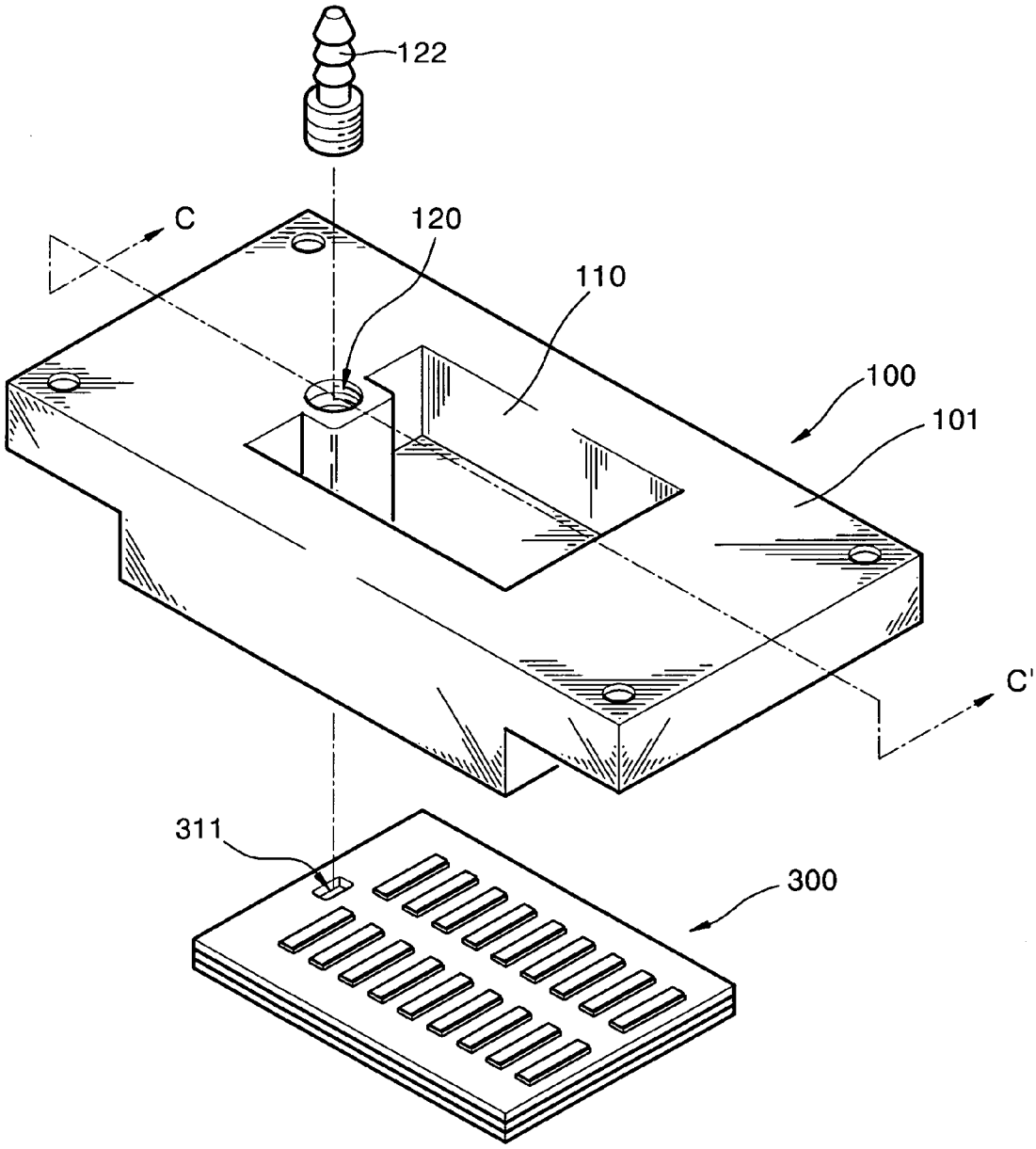
FIG. 5 illustrates an exploded view of an ink-jet printhead package according to a preferred embodiment of the present invention.
Figure 6:
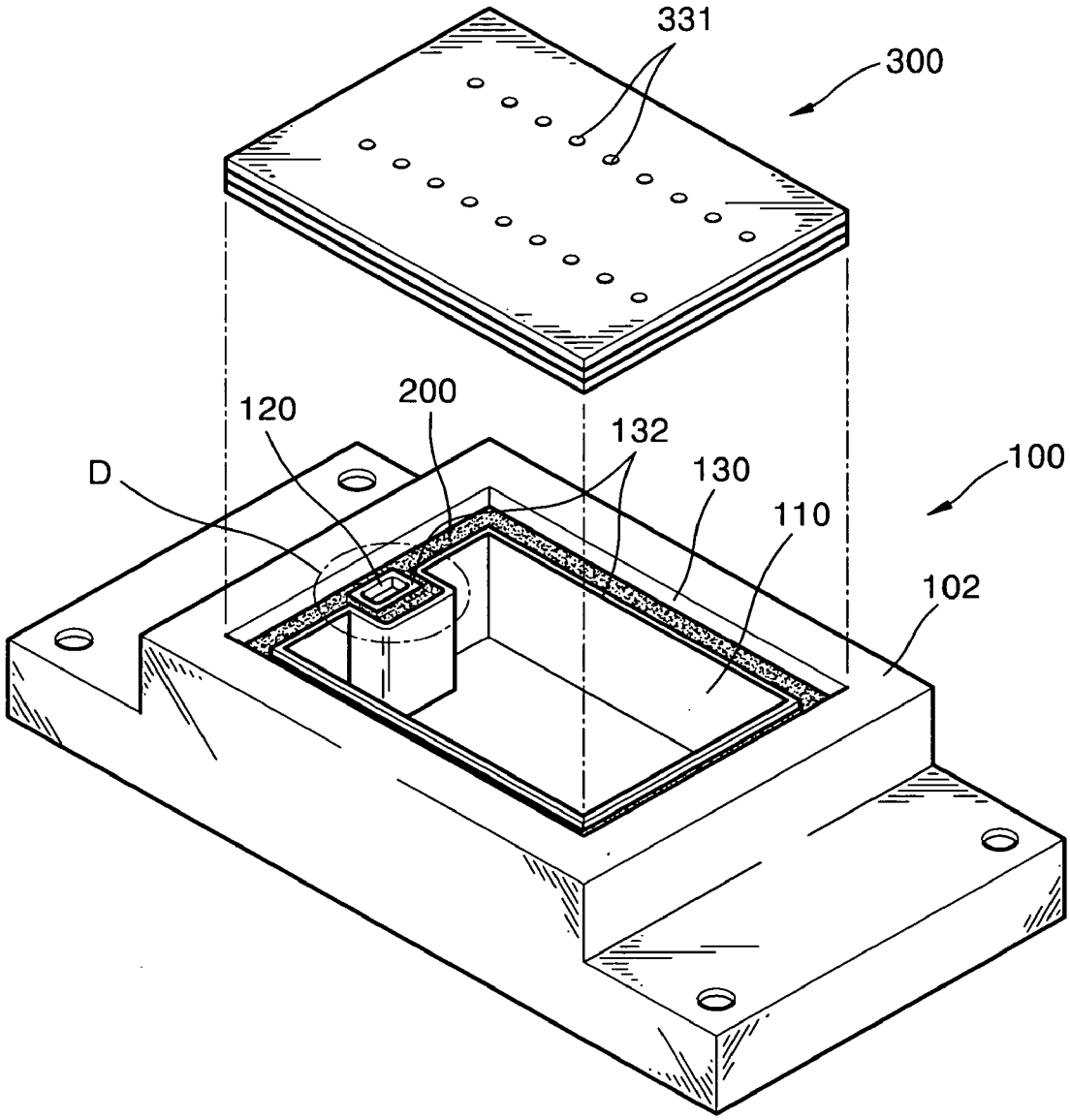
FIG. 6 illustrates an exploded view of a side of the ink-jet printhead package according to the preferred embodiment of the present invention shown in FIG. 5.

FIG. 5 illustrates an exploded view of an ink-jet printhead package according to a preferred embodiment of the present invention. FIG. 6 illustrates an exploded view of a side of the ink-jet printhead package according to the preferred embodiment of the present invention shown in FIG. 5.

Referring to FIGS. 5 and 6, the ink-jet printhead package according to the present invention includes a frame 100 and a printhead chip 300 that is adhered to the frame 100 by an adhesive 200.

The frame 100 has a first surface 101 and a second surface 102 with a hollow 110 and an ink supply hole 120 that extend through the frame. The ink supply hole 120 is adjacent to the hollow 110 and provides flow communication between the first surface and the second surface. A nipple 122, in which an ink supply hose (430 of FIG. 9) that will be described later is inserted, is installed in the ink supply hole 120. The frame 100 may be formed of plastic, and the nipple 122 may be formed of stainless steel.

A groove 130, which surrounds the hollow 110 and the ink supply hole 120, is formed to a predetermined depth on the second surface 102 of the frame 100. The adhesive 200, by which the printhead chip 300 is adhered to the frame 100, coats an interior of the groove 130.

A variety of types of adhesives that provide a high adhesion property and a high sealing characteristic may be used as the adhesive 200. In the preferred embodiment of the present invention, a room temperature vulcanizing (RTV) silicon resin is used for the adhesive 200. The RTV silicon resin is highly adhesive and has a high sealing characteristic and an advantage of not requiring a user to press or heat the adhesive 200 for vulcanization. In addition, the RTV silicon resin does not react with ink, does not itself deteriorate, and does not deteriorate ink.

Alternatively, the adhesive 200 may include a combination of an RTV silicon resin and an epoxy resin. The epoxy resin has a variety of vulcanizing mechanisms that depend on a type thereof and has superior adhesiveness as compared to the RTV silicon resin. However, the epoxy resin reacts with ink. Thus, it is preferable that an RTV silicon resin, which does not react with ink, is coated on a peripheral region D of the ink supply hole 120 that has a greater likelihood of contacting ink, i.e., an interior of a portion of the groove 130 surrounding the ink supply hole 120, and an epoxy resin, which does react with ink but has superior adhesiveness, is coated on an interior of a portion of the groove 130 substantially surrounding the hollow 110, which area has a lower likelihood of contacting ink.

Figure 7:
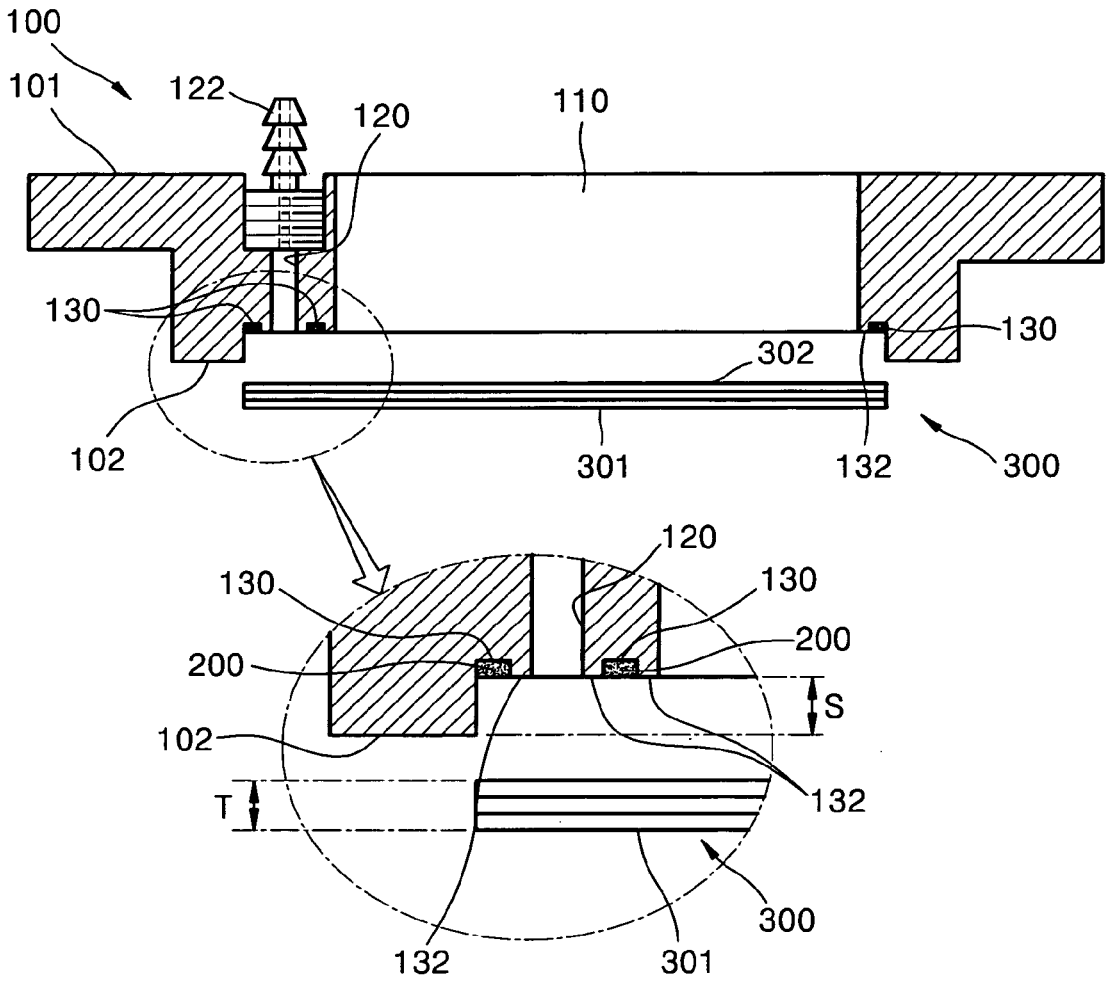
FIG. 7 illustrates a vertical cross-sectional view taken along line C–C' of the ink-jet printhead package of FIG. 5.

FIG. 7 illustrates a vertical cross-sectional view taken along line C–C' of the ink-jet printhead package of FIG. 5.

Referring to FIG. 7, a support surface 132 contacts and supports the printhead chip 300. The support surface 132 is formed by an inner edge of the groove that is adjacent to the hollow 110 and the ink supply hole 120. The support surface 132 is recessed a predetermined depth S from the second surface 102 of the frame 100.

Preferably, the predetermined depth S is greater than or equal to a thickness T of the printhead chip 300. In particular, when the predetermined depth S is substantially the same as the thickness T of the printhead chip 300, a first surface 301 (hereinafter, referred to as a nozzle surface) of the printhead chip 300 and the second surface 102 of the frame 100 are coplanar.

The printhead chip 300 ejects ink, which is supplied through an ink induction hole 311 that is aligned with the ink supply hole 120, through a plurality of nozzles 331 formed on the nozzle surface 301 of the printhead chip 300. As described above, a second surface 302 of the printhead chip 300 is securely adhered to the frame 100 by the adhesive 200.

A process of adhering the printhead chip 300 to the frame 100 is performed as follows. First, when the frame 100 is upside-down, i.e., when the groove 130 formed on the second surface 102 of the frame 100 faces upward, the adhesive 200, such as the RTV silicon resin or the epoxy resin, is coated on an interior of the groove 130. The adhesive 200 may either be in a liquid state or a paste state. Subsequently, the second surface 302 of the printhead chip 300 is put on the adhesive 200 and is compressed into the frame 100 using a compression plate. At this time, it is preferable that the frame 100 is returned to an original, upright position so that the printhead chip 300 faces downward. This reorientation is necessary because, even when the adhesive 200 does not sufficiently fill in the groove 130, a contact surface between the printhead chip 300 and the frame 100 can be sealed more securely. After a predetermined period of time passes in this orientation, the adhesive 200 is vulcanized, and the printhead chip 300 is securely adhered to the frame 100. When the compression plate is removed after the adhesive 200 is vulcanized, the process of adhering the printhead chip 300 to the frame 100 is completed.

As described above, the ink-jet printhead package according to an embodiment of the present invention does not include a conventional head cover. In addition, the nozzle surface 301 of the printhead chip 300 and the second surface 102 of the frame 100 are coplanar. Accordingly, a wiping blade is able to contact the entire nozzle surface 301 of the printhead chip 300. Thus, the nozzle surface 301 is easily wiped such that removal of foreign substances and ink that remain on the nozzle surface 301 is improved. Further, a number of elements constituting the printhead package are reduced, such that the ink-jet printhead package has a simplified structure, thereby reducing the size and cost thereof.

Figure 8:
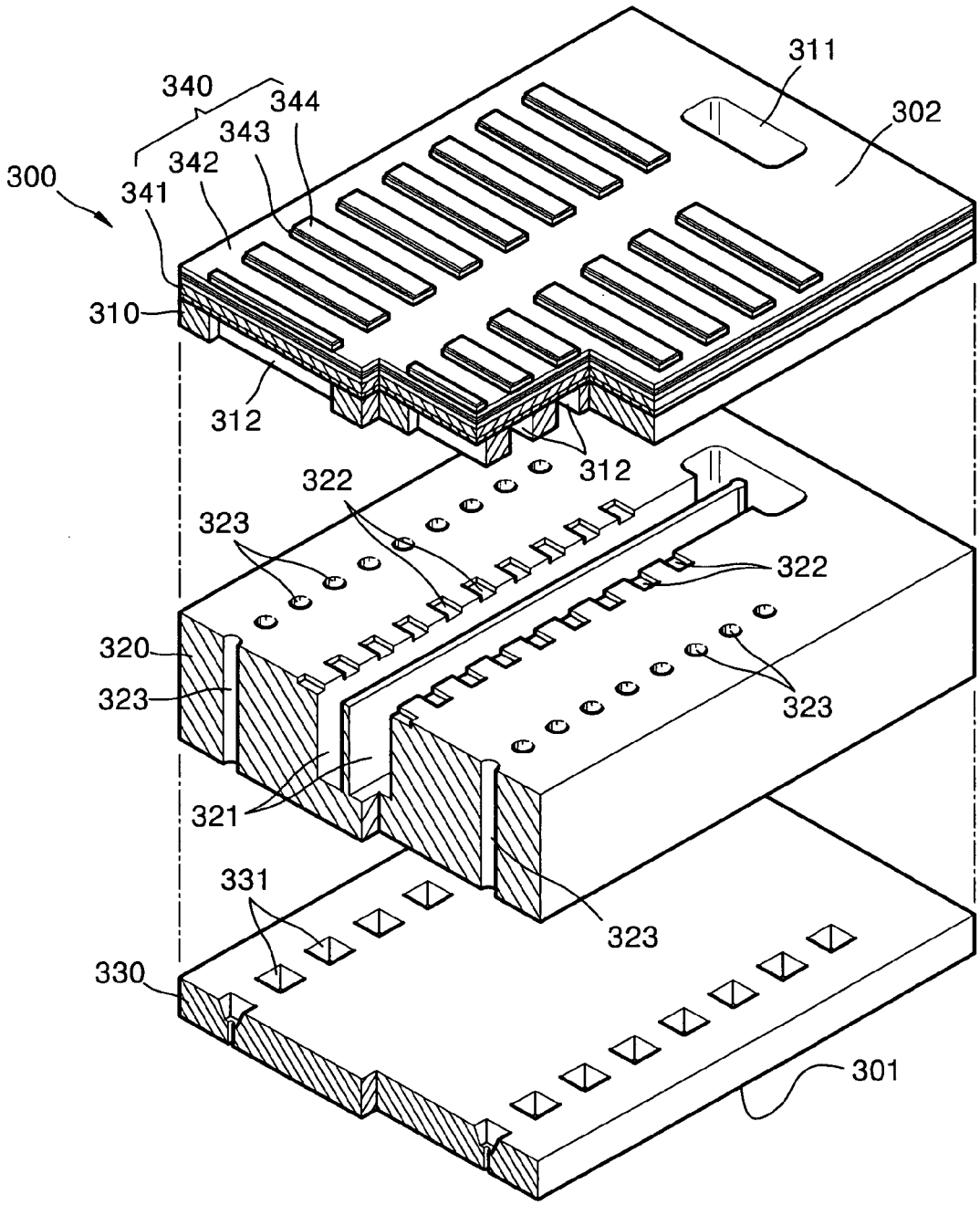
FIG. 8 illustrates an exploded partial cross-sectional view of a printhead chip shown in FIG. 5.

FIG. 8 illustrates an exploded view of the printhead chip 300 in FIG. 5. Referring to FIG. 8, the printhead chip 300 includes a plurality of ink chambers 312 to be filled by ink supplied through the ink supply hole 120; a plurality of nozzles 331 formed at positions corresponding to the plurality of ink chambers 312; and an actuator 340 for providing a driving force to eject ink inside the ink chambers 312 through the nozzles 331. Preferably, the actuator 340 is a piezoelectric type actuator.

Further, the printhead chip 300 may be formed by stacking an upper substrate 310, a middle substrate 320, and a lower substrate 330, and adhering the substrates 310, 320, and 330 together. Elements for forming an ink passage are formed on each of the three substrates 310, 320, and 330, and the piezoelectric actuator 340 is formed on the upper substrate 310. The ink induction hole 311, which aligns with the ink supply hole 120, and the plurality of ink chambers 312 are formed on the upper substrate 310. The ink chambers 312 are arranged in two rows on both sides of a reservoir 321, which is formed on the middle substrate 320.

The piezoelectric actuator 340, which is formed on the upper substrate 310, includes a vibration plate 341 located on the plurality of ink chambers 312, and a piezoelectric body 343 located on the vibration plate 341, the piezoelectric body 343 being operable to vibrate the vibration plate 341. A lower electrode 342, which serves as a common electrode, is located under the piezoelectric body 343, and an upper electrode 344, which serves as a driving electrode for applying a voltage to the piezoelectric body 343, is located on the piezoelectric body 343.

The reservoir 321, which provides flow communication between the ink induction hole 311 and the plurality of ink chambers, is formed along a length of the middle substrate 320 to a predetermined depth. In addition, a plurality of restrictors 322, which provides flow communication between the reservoir 321 and a first end of each of the ink chambers 312, is formed to be shallower than the reservoir 321. A plurality of dampers 323 vertically perforates the middle substrate 320 at positions corresponding to a second end of the ink chambers 312.

The plurality of nozzles 331 vertically perforates the lower substrate 330 in positions corresponding to the plurality of dampers 323.

The three substrates 310, 320, and 330 that are formed in this manner, as described above, are stacked and adhered together to form the printhead chip 300 according to an embodiment of the present invention.

An operation of the printhead chip 300 having the above structure will now be described. Ink flowing to the reservoir 321 through the ink supply hole 120 and the ink induction hole 311 from an ink cartridge (not shown) is supplied to the ink chambers 312 through the restrictors 322. If the ink chambers 312 are filled with ink when a voltage is applied to the piezoelectric body 343 through the upper electrode 344 of the piezoelectric actuator 340, the piezoelectric body 343 is deformed and the vibration plate 341 is bent downward. Due to the deformation of the vibration plate 341, the volumes of the ink chambers 312 are reduced. Due to a pressure increase in the ink chambers 312 caused by the reduction in the volumes of the ink chambers 312, ink in the ink chambers 312 passes through the dampers 323 and is ejected to the outside through the nozzles 331.

Subsequently, when the voltage that has been applied to the piezoelectric body 343 of the piezoelectric actuator 340 is cut off, the piezoelectric body 343 is returned to an original shape thereof. Thus, the vibration plate 341 is returned to an original shape thereof, and the volumes of the ink chambers 312 increase. Due to the reduction in the pressure inside the ink chambers 312, ink that is stored in the reservoir 321 flows into the ink chamber 312 through the restrictors 322, and the ink chambers 312 are filled with ink.

Figure 9:
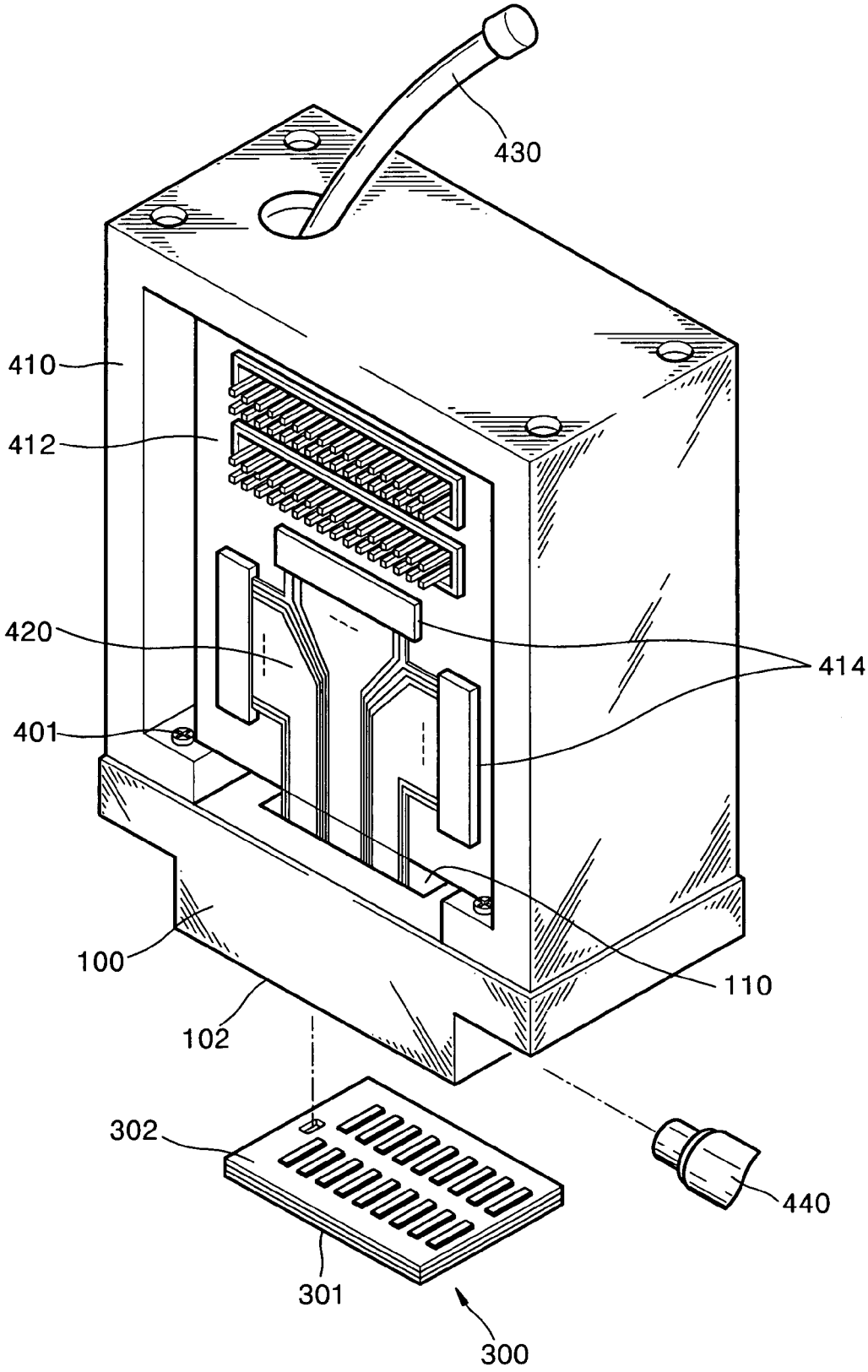
FIG. 9 illustrates a perspective view of the ink-jet printhead package in the context of incorporation with additional elements.

An ink-jet printhead package in the context of incorporation with additional elements is shown in FIG. 9.

Referring to FIG. 9, a bracket 410 is combined with an upper portion of the frame 100 to which the printhead chip 300 is adhered. Combination of the frame 100 and the bracket 410 may be performed using a screw 401. A printed circuit board (PCB) 412 that drives the printhead chip 300 is installed in the bracket 410.

The PCB 412 and the printhead chip 300 are electrically connected by a flexible printed circuit (FPC) 420. The FPC 420 may be connected to the PCB 412 and the printhead chip 300 through the hollow 110 of the frame 100. A plurality of connectors 414 for connecting the FPC 420 is provided on the PCB 412.

A first end of an ink supply hose 430 is connected to the ink supply hole 120 of the frame 110. A second end of the ink supply hose 430 is connected to an ink container mounted in the printer. As previously described, a nipple (122 of FIG. 5) in which the ink supply hose 430 is inserted may be installed in the ink supply hole 120.

Experimental results of testing the adhesive properties and the sealing characteristics of the printhead chip with respect to the ink-jet printhead package according to an embodiment of the present invention are as follows. When the printhead chip has been driven at a temperature of 70° C. for about one hour, it is ascertained that ink does not leak. When ink is supplied to the printhead chip under a pressure of eight (8) psi, it is ascertained that there is no deficiency in the sealing. It is also ascertained that there is no deficiency in the adhering condition of the printhead chip after the experiment is done. It is concluded from the experimental results that the components of the ink-jet printhead package are sufficiently adhesive, and the ink-jet printhead package is sufficiently sealed, even when the printhead chip is adhered to the frame using the adhesive without the head cover according to the preferred embodiment of the present invention.

A CCD camera 440 is used when characteristics of ink ejection are measured for the printhead chip 300, as shown in FIG. 9. In a conventional ink-jet printhead package, since a view of the CCD camera 440 is obstructed by the head cover, there is a difficulty in measuring an ink ejection speed immediately after the ink leaves the nozzles. However, since the printhead package according to the preferred embodiment of the present invention does not include a head cover and the nozzle surface 301 of the printhead chip 300 and the second surface 102 of the frame 100 are coplanar, it is relatively easy to measure the ink ejection speed immediately after the ink leaves the nozzles 331 using the CCD camera 440.

As described above, in the ink-jet printhead package according to the preferred embodiment of the present invention, because a conventional head cover is not provided, the nozzle surface of the printhead chip and the second surface of the frame are coplanar. As such, the nozzle surface of the printhead chip is easily wiped using the wiping blade, and removal of foreign substances and ink that remain on the nozzle surface is improved. Thus, a problem with conventional ink-jet printhead packages in that ink is able to spread between the head cover and the frame does not occur.

In addition, the number of elements constituting the printhead package is reduced, such that the structure of the printhead package is simplified, thereby reducing the size and costs thereof.

In addition, since there is no head cover and the nozzle surface of the printhead chip and the second surface of the frame are coplanar, the ejection characteristics of ink droplets through the nozzles are easily measured.

Preferred embodiments of the present invention have been disclosed herein and, although specific terms are employed, they are used and are to be interpreted in a generic and descriptive sense only and not for purpose of limitation. For example, although the present invention is shown and described in an ink-jet printhead package having a piezoelectric type printhead chip, the present invention is not limited to this, but may be used in a printhead package having an electro-thermal transducer type printhead chip. In addition, although the RTV silicon resin and the epoxy resin are used as the adhesive by which the printhead chip is adhered to the frame, different types of adhesives having an adhesion property and a sealing characteristic can be used. Accordingly, it will be understood by those of ordinary skill in the art that various changes in form and details may be made without departing from the spirit and scope of the present invention as set forth in the following claims.

What is claimed is:

1. An ink-jet printhead package, comprising:

a frame having:

a first surface and a second surface; a hollow; and an ink supply hole, the hollow and the ink supply hole extending through the frame, the ink supply hole providing flow communication between the first surface and the second surface;

a support surface recessed into the second surface of the frame by a predetermined depth and surrounding the hollow and the ink supply hole; and a groove formed in the support surface;

an adhesive coating an interior of the groove; and a printhead chip having a first surface and a second surface, the first surface of the printhead chip having a plurality of nozzles formed thereon and the second surface of the printhead chip being adhered to the frame by the adhesive, the printhead chip being operable to eject ink supplied through the ink supply hole through the plurality of nozzles, wherein the printhead chip is disposed on the support surface and has a thickness that is less than or substantially equal to the predetermined depth, so that the first surface of the printhead chip does not project beyond the second surface of the frame, and the adhesive includes:

a room temperature vulcanizing (RTV) silicon resin coating an interior of a first portion of the groove, the first portion of the groove surrounding the ink supply hole; and an epoxy resin coating an interior of a second portion of the groove, the second portion of the groove substantially surrounding the hollow.

2. The ink-jet printhead package as claimed in claim 1, wherein the frame is formed of plastic.

3. The ink-jet printhead package as claimed in claim 1, wherein the predetermined depth is substantially equal to the thickness of the printhead chip so that the first surface of the printhead chip and the second surface of the frame are coplanar.

4. The ink-jet printhead package as claimed in claim 1, wherein the printhead chip comprises:

a plurality of ink chambers to be filled by ink supplied through the ink supply hole;

a plurality of nozzles formed at positions corresponding to the plurality of ink chambers; and an actuator for providing a driving force to eject ink inside the ink chambers through the plurality of nozzles.

5. The ink-jet printhead package as claimed in claim 4, wherein the actuator is a piezoelectric actuator, and the piezoelectric actuator includes:

a vibration plate located on the plurality of ink chambers; and a piezoelectric body located on the vibration plate, the piezoelectric body being operable to vibrate the vibration plate.

6. The ink-jet printhead package as claimed in claim 5, wherein the piezoelectric actuator further comprises:

a lower electrode located under the piezoelectric body, the lower electrode serving as a common electrode; and an upper electrode located on the piezoelectric body, the upper electrode serving as a driving electrode for applying a voltage to the piezoelectric body.

7. The ink-jet printhead package as claimed in claim 5, wherein the printhead chip comprises:

an upper substrate having the plurality of ink chambers and an ink induction hole aligned with the ink supply hole formed therein;

a middle substrate having a reservoir and a plurality of restrictors providing flow communication between the ink induction hole and the plurality of ink chambers, and a plurality of dampers providing flow communication between the plurality of ink chambers and the plurality of nozzles formed therein; and a lower substrate having the plurality of nozzles formed therein, the piezoelectric actuator being formed on the upper substrate.

8. The ink-jet printhead package as claimed in claim 1, further comprising:

a bracket, in which a printed circuit board is installed, combined with an upper portion of the frame, wherein the printed circuit board and the printhead chip are electrically connected by a flexible printed circuit; and an ink supply hose providing flow communication to the ink supply hole.

9. The ink-jet printhead package as claimed in claim 8, further comprising a nipple, in which the ink supply hose is inserted, installed in the ink supply hole.

10. The ink-jet printhead package as claimed in claim 9, wherein the nipple is formed of stainless steel.

11. An ink-jet printhead package, comprising:

a frame having a first surface and a second surface with a hollow and an ink supply hole, the hollow and the ink supply hole extending through the frame, the ink supply hole providing flaw communication between the first surface and the second surface;

a groove formed on the second surface of the frame, the groove surrounding the hollow and the ink supply hole;

an adhesive coating an interior of the groove; and a printhead chip having a first surface and a second surface, the first surface of the printhead chip having a plurality of nozzles formed thereon and the second surface of the printhead chip being adhered to the frame by the adhesive, the printhead chip being operable to eject ink supplied through the ink supply hole trough the plurality of nozzles, wherein the printhead chip includes:

a plurality of ink chambers to be filled by ink supplied through the ink supply hole;

a plurality of nozzles formed at positions corresponding to the plurality of ink chambers;

an actuator for providing a driving force to eject ink inside the ink chambers trough the plurality of nozzles, wherein the actuator is a piezoelectric actuator, and the piezoelectric actuator includes:

a vibration plate located on the plurality of ink chambers; and a piezoelectric body located on the vibration plate, the piezoelectric body being operable to vibrate the vibration plate;

an upper substrate having the plurality of ink chambers and an ink induction hole aligned with the ink supply hole formed therein;

a middle substrate having a reservoir and a plurality of restrictors providing flow communication between the ink induction hole and the plurality of ink chambers, and a plurality of dampers providing flow communication between the plurality of ink chambers and the plurality of nozzles formed therein; and a lower substrate having the plurality of nozzles formed therein, the piezoelectric actuator being formed on the upper substrate.

12. An ink-jet printhead package, comprising:

a frame having a first surface and a second surface with a hollow and an ink supply hole, the hollow and the ink supply hole extending through the frame, the ink supply hole providing flow communication between the first surface and the second surface;

a groove formed on the second surface of the frame, the groove surrounding the hollow and the ink supply hole;

an adhesive coating an interior of the groove;

a printhead chip having a first surface and a second surface, the first surface of the printhead chip having a plurality of nozzles formed thereon and the second surface of the printhead chip being adhered to the frame by the adhesive, the printhead chip being operable to eject ink supplied through the ink supply hole through the plurality of nozzles;

a bracket, in which a printed circuit board is installed, combined with an upper portion of the frame, wherein the printed circuit board and the printhead chip are electrically connected by a flexible printed circuit;

an ink supply hose providing flow communication to the ink supply hole; and a nipple, in which the ink supply hose is inserted, installed in the ink supply hole.

13. The ink-jet printhead package as claimed in claim 12, wherein the nipple is formed of stainless steel.

* * * * *